United States Patent [19]

Muto

[11] Patent Number: 4,623,261

[45] Date of Patent: Nov. 18, 1986

[54] ELECTRONIC TIMEPIECE WITH A CHRONOGRAPH SYSTEM

[75] Inventor: Takeo Muto, Tanashi, Japan

[73] Assignee: Citizen Watch Co., Ltd., Tokyo, Japan

[21] Appl. No.: 780,024

[22] Filed: Sep. 25, 1985

[30] Foreign Application Priority Data

Sep. 26, 1984 [JP] Japan ..... 59-145384
Sep. 29, 1984 [JP] Japan ..... 59-205383

[51] Int. Cl.[4] ..... G04B 19/04; G04F 8/00

[52] U.S. Cl. ..... 368/80; 368/110; 368/113

[58] Field of Search ..... 368/76, 80, 101–103, 368/107, 110–113

[56] References Cited

U.S. PATENT DOCUMENTS 4,212,158 7/1980 Tamaru ..... 368/80
4,270,197 5/1981 Minowa ..... 368/113 X
4,364,669 12/1982 Thoenig ..... 368/80 X
4,389,122 8/1983 Dubois et al. ..... 368/110
4,523,857 6/1985 Ushikoshi ..... 368/107
4,537,514 8/1985 Moriya ..... 368/110

*Primary Examiner*—Vit W. Miska
*Attorney, Agent, or Firm*—Birch, Stewart, Kolasch & Birch

[57] ABSTRACT

An electronic timepiece has a minute hand, hour hand, chronograph second hand, chronograph minute hand and chronograph hour hand. A first gear train is provided for transmitting the output of a motor to a second wheel of the chronograph second hand. A second gear train is provided for transmitting the rotation of the chronograph second wheel to a minute wheel of the chronograph minute hand, and a third gear train is separately provided from the first gear train and provided for transmitting the rotation of the chronograph second wheel to an hour wheel of the chronograph hour hand.

6 Claims, 12 Drawing Figures

ELECTRONIC TIMEPIECE WITH A CHRONOGRAPH SYSTEM

BACKGROUND OF THE INVENTION

The present invention relates to an electronic watch with a chronograph system having an analog time-display.

In the analog watch having a chronograph system, it is necessary to provide a chronograph second hand, chronograph minute hand, chronograph hour hand, and gear trains for transmitting the torque from a motor to each hand. In such a watch, chronograph second, minute and hour hands are not co-axial, but are positioned at separated positions so as to independently indicate the chronograph time. Generally, the gear train for the chronograph system comprises a plurality of gears which are engaged in series from a gear of a chronograph second hand shaft to a gear for the hour hand through a gear for the minute hand.

On the other hand, it is preferable in design to dispose those hands in symmetry with respect to the center (axis) of the watch. However, in order to meet such a requirement, the gear train becomes very complicated in construction and arrangement. Moreover, such a disposition of hands causes the increase of the watch in thickness, because parts of the gear train and/or hands overlap with other parts of the watch, such as a gear train for normal (standard) time display hands, and/or levers in the chronograph system.

SUMMARY OF THE INVENTION

An object of the present invention is to provide an arrangement of a gear train for a chronograph system which may be disposed in simple construction in accordance with disposition of chronograph hands.

To this end, the gear train of the present invention is arranged in parallel for transmitting the torque to each chronograph hand.

Another object of the present invention is to provide a watch the thickness of which may be reduced.

According to the present invention, there is provided an electronic timepiece with a chronograph system having a minute hand, hour hand, first chronograph second hand, chronograph minute hand and chronograph hour hand, comprising: a first motor for driving the first chronograph second hand; a first gear train for transmitting the output of the first motor to a second wheel of the chronograph second hand. A second gear train is provided for transmitting the rotation of the chronograph second wheel to a minute wheel of the chronograph minute hand, and a third gear train is separately provided from the second gear train and provided for transmitting the rotation of the chronograph second wheel to an hour wheel of the chronograph hour hand.

In an aspect of the present invention, the electronic timepiece further comprises a second motor for driving the minute hand and hour hand, and slipping means provided in the second gear train and third gear train for causing the slipping of a part of each of the gear trains to cause the chronograph second hand to indicate the normal time. Further, a second chronograph second hand is provided for indicating the chronograph second at smaller unit than the first chronograph second hand, and a power transmitting system for the second chronograph second hand is disposed in a space between a battery and a stem provided in the timepiece.

These and other objects and features of the present invention will become more apparent from the following description with reference to the accompanying drawings.

DESCRIPTION OF THE PREFERRED EMBODIMENT

Figure 1:
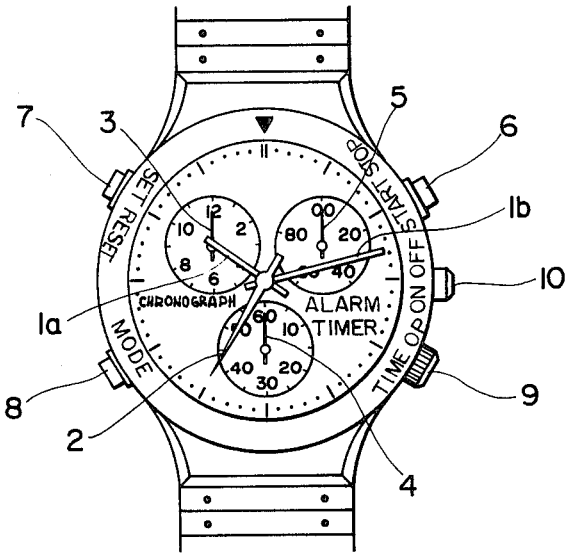
FIG. 1 is a plan view of an analog time-display electronic watch with a chronograph system.

Referring to FIG. 1, an analog time-display electronic watch with a chronograph system comprises an hour hand 1a and a minute hand 1*b* for indicating the normal standard time and alarm time, and a second hand 2. In accordance with the present invention, the second hand is used for indicating both of the normal time and chronograph time.

A chronograph (CG) hour hand 3 indicates hour of chronograph time and rotates one revolution per 12 hours. A chronograph (CG) minute hand 4 indicates minute of the chronograph time and makes one rotation 60 minutes. A chronograph (hereinafter called CG) 2/100-second hand 5 indicates 2/100 seconds of the chronograph time and makes one rotation one second at the rate of each step per 1/50 second. Further, the watch can be used as a timer. In timer operation, the CG 2/100-second hand 5 is adapted to indicate a residual time of set time. The timer is so arranged as to have a set time of 49 minutes at the maximum. The watch is provided with external manipulating means.

The external manipulating means comprises a start/-stop button 6 for causing the start and stop of the chronograph and the timer, a set/reset button 7 for causing the reset of the chronograph and setting of the timer, and a changeover button 8 for changing the normal time indicating mode to the chronograph time indicating mode. A crown 9 is normally positioned at an innermost position and is adapted to be axially pulled to an intermediate position and an outermost position. When the crown 9 is rotated clockwise or counterclockwise at the outermost position, the normal time indicated by hour and minute hands 1*a,* 1*b* can be corrected. At the intermediate position, the system is changed to the alarm time setting state. By rotating the crown 9 clockwise or counterclockwise. The set alarm time can be corrected. An alarm button 10 is provided for switching between an alarm ON-state and alarm OFF-state. When the on alarm button 10 is at a pushed position, the alarm sound is stopped. At a pulled position, the alarm sound can be expected.

When the crown 9 is at the innermost position, the normal time is indicated by the hour hand 1*a*, minute hand 1*b*, and second hand 2. The CG hour hand 3, minute hand 4, and 2/100-second hand 5 are respectively positioned at zero positions.

When the chronograph system is used, the changeover button 8 is pushed once. The second hand 2 is rotated by a motor at high speed, for example 64 Hz pulses, to the zero second position so that the system is changed to the chronograph mode. When the start/stop button 6 is pushed. the CG 2/100-second hand 5 starts rotating at the rate of 2/100 seconds per step by a sole motor. At the same time, the second hand 2 is driven as a CG second hand at the rate of one second per step by a common motor. Further, the CG minute hand 4 and CG hour hand 3, which cooperates with the second hand 2 through gear trains, as will be hereinafter described, start rotating at the rate of one second per step to make one rotation 60 minutes and one rotation 12 hours, respectively. When, the start/stop button 6 is pushed again, CG hands 2, 3, 4 and 5 are stopped to indicate the elapsed time.

In order to continue the chronograph time measurement, the button 6 is pushed again, and chronograph operations are repeated in the same manner as hereinbefore described so that the integrated time is indicated.

When the set/reset button 7 is pushed, while each of CG hands is at a stop, CG hour and minute hands 3 and 4 are driven to the zero positions in a moment and the second hand 2 and CG 2/100-second hand 5 are quickly rotated to the zero second positions at 64 Hz. Thus, the system is in a chronograph reuse state. By pushing the start/stop button 6, the chronograph system restarts for measurement of time.

After the chronograph operation is finished, when the changeover button 8 is pushed, CG minute and hour hands 4, 3 are driven to the zero positions in a moment and the second hand 2 is quickly returned to the second time indicating position of the normal time at 64 Hz. Thus, the second hand 2 indicates the second of the normal time. The change to the normal time can also be achieved even if the chronograph system is operated or at a stop.

In order to use the timer, the set/reset button 7 is pushed in the normal time indicating state. The timer is indicated by the CG 2/100-second hand 5. The hand 5 is rotated by one minute at every push of the set/reset button 7, and 49 minutes can be set in the timer. After setting a desired time, pushing of the start/stop button 6 causes the timer to start. The CG 2/100-second hand 5 is driven at the rate of one step per one minute and alarm sound generates at the set time even if the timer is set, unless the button 6 is pushed, the hand 5 does not move. In order to prevent the mis-operation of the timer, pushing of the set/reset button 7 during the timer operation does not cause a new setting of the timer.

Further, the CG 2/100-second hand 5 can also be used as a modulo-50 counter which integrately counts one by one by pushing the set/reset button 7.

Figure 2:
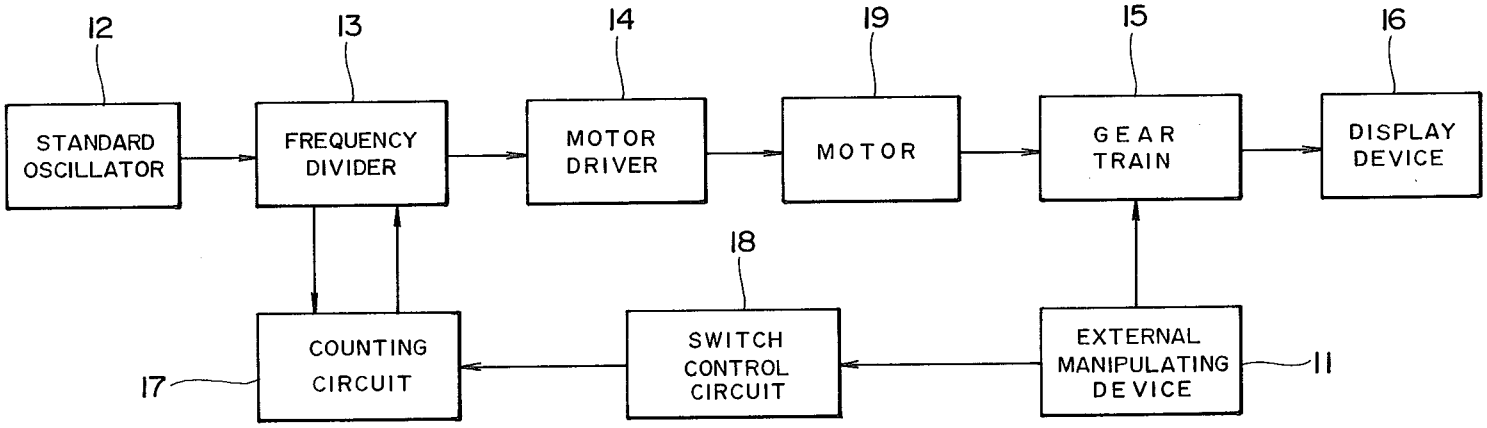
FIG. 2 is a schematic block diagram showing a part of a watch system.

FIG. 2 shows a schematic block diagram of a watch system according to the present invention. The system comprises a standard oscillator 12 comprising a crystal oscillator, a signal of which is divided into predetermined frequencies by a frequency divider 13. One of divided signals from the divider 13 is applied to a display device 16 through a motor driver 14, a motor 19, and a gear train 15 to indicate the normal time, in the same manner as a conventional analog time-display watch. The divider 13 and a counting circuit 17 apply signals to each other. External manipulating means 11 which includes push buttons 6, 7, 8 and 10 and crown 9 is provided to control the gear train 15 and a switch control circuit 18. The counting circuit 17 is controlled by a signal from the switch control circuit 18.

Figure 3:
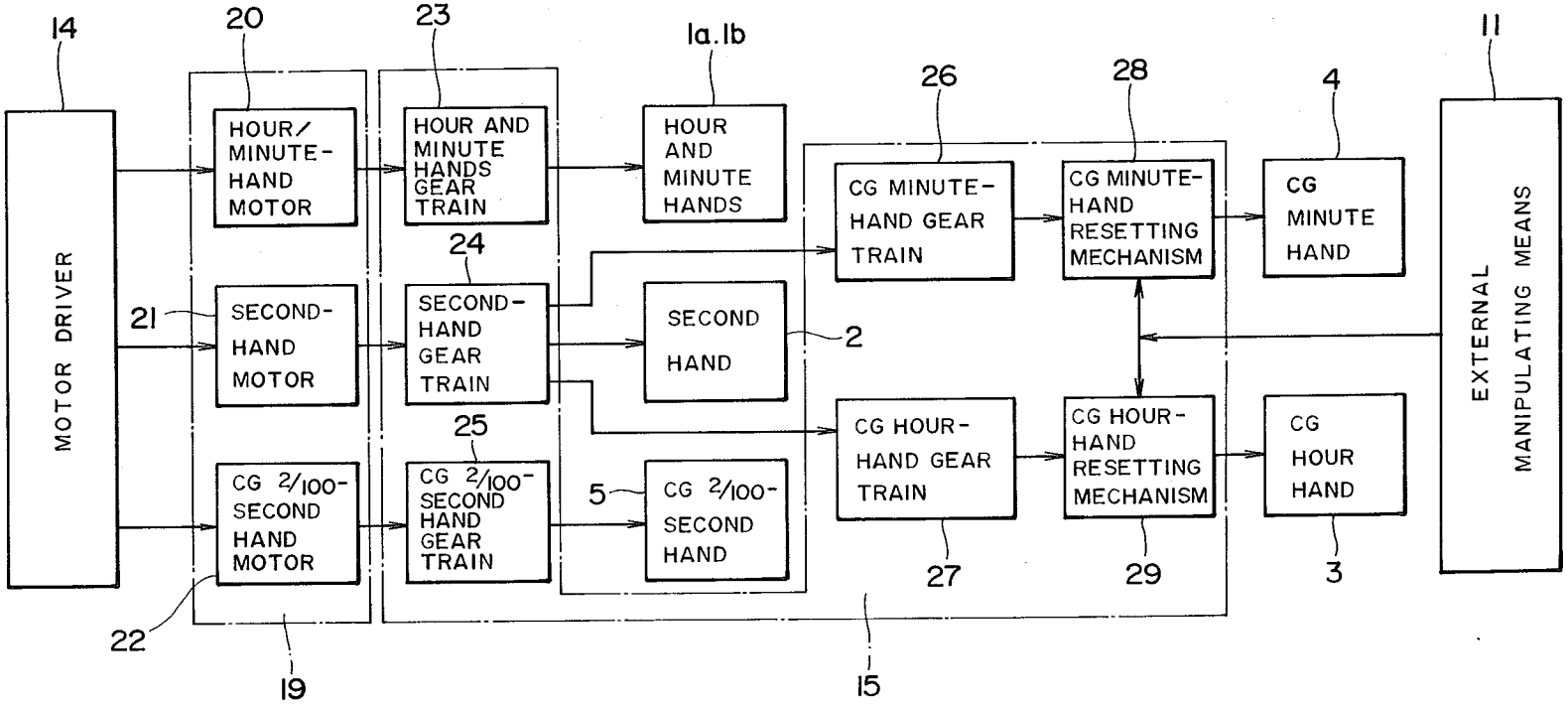
FIG. 3 is a schematic block diagram showing a part of gear train construction.

FIG. 3 is a schematic block diagram showing the relationship between external manipulating means 11 and gear train 15. The motor 19 includes an hour/minute-hand motor 20 for driving hour and minute hands 1*a*, 1*b* through an hour and minute hands gear train 23, a second-hand motor 21 for driving the second hand 2 through a second-hand gear train 24, and a CG 2/100-second hand motor 22 for driving the CG 2/100-second hand 5 through a CG 2/100-second hand gear train 25. Those motors 20, 21 and 22 are driven by the motor driver 14. When the chronograph system is used, the second-hand gear train 24 driven by the motor 21 is adapted to cooperate with a CG minute-hand gear train 26 for driving the CG minute hand 4 and a CG hour-hand gear train 27 for driving the CG hour hand 3. A CG minute-hand resetting mechanism 28 is provided between the CG minute-hand gear train 26 and CG minute hand 4, and a CG hour-hand resetting mechanism 29 is provided between the CG hour-hand gear tran 27 and CG hour hand 3. These resetting mechanisms 28, 29 are provided for controlling the CG minute hand 4 and the CG hour hand 3, respectively, by operating external manipulating means 11.

Figure 4:
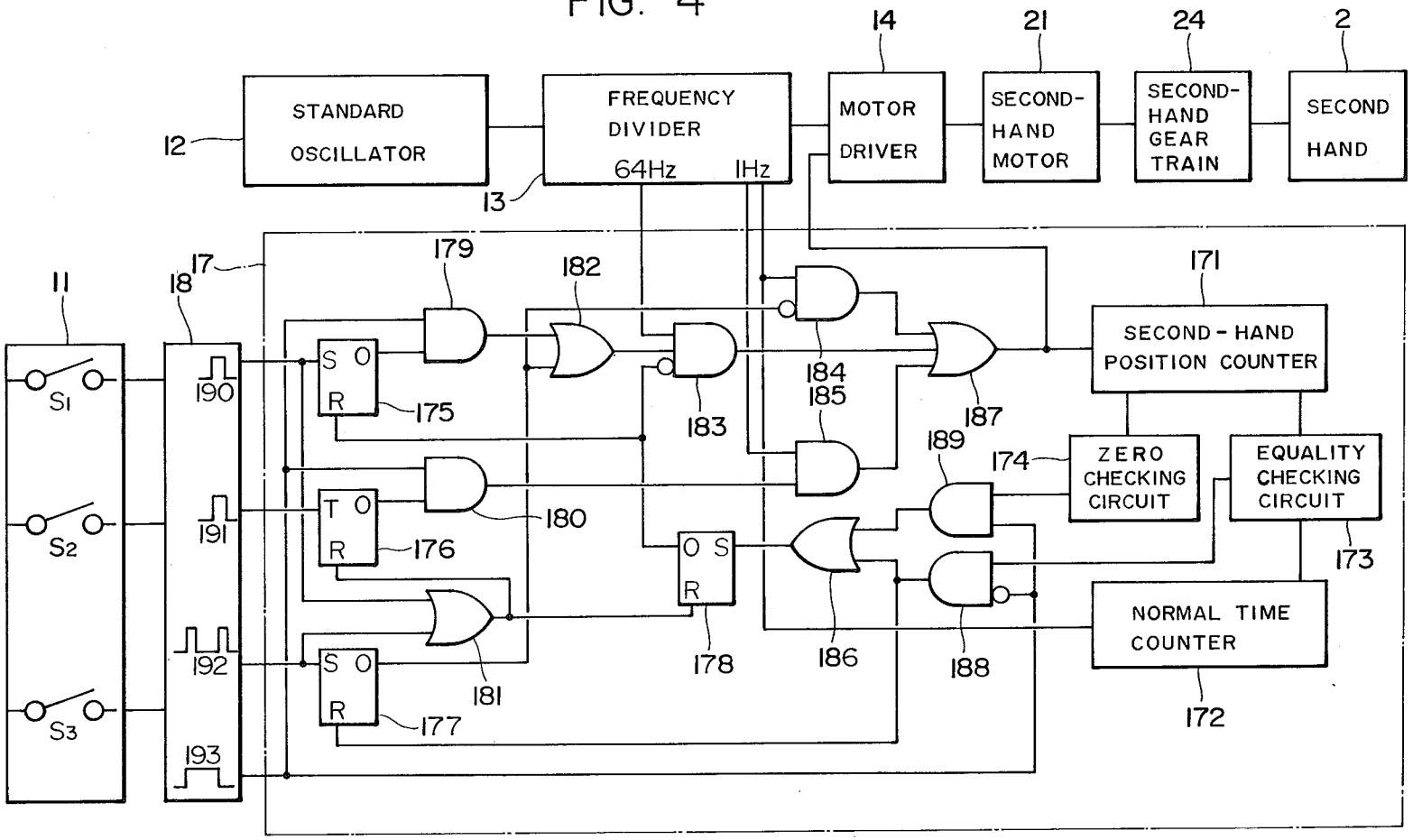
FIG. 4 is a schematic block diagram showing a circuit for the chronograph system.

FIG. 4 is a schematic block diagram showing the relationship between manipulating means 11 and circuit means 17, 18 of FIG. 2. A signal of the standard oscillator 12 forming a time standard signal is applied to the frequency divider 13 to be divided and compounded into a predetermined proper signal, which is applied to the motor driver 14 for driving the second-hand motor 21. The external manipulating means 11 comprises an S/S switch S2 corresponding to the start/stop button 6, an R/S switch S1 corresponding to the set/reset button 7, and a changeover switch S3 corresponding to the changeover button 8. Each of output signals generated from respective switches are applied to the switch control circuit 18. The circuit 18 produces one-shot pulse signals 190 and 191 in response to output signals of R/S switch S1 and S/S switch S2, respectively. Further, the circuit 18 produces a high (H) level signal 193 and one-shot pulse signal 192 in response to the output signal at the close of the changeover switch S3, and produces a low (L) level signal 193 and one-shot pulse signal 192, when the switch S3 is opened.

The counting circuit 17 comprises a second-hand position counting circuit 171 which is a modulo-60 counter, a normal time counter 172 of modulo-60 counter, an equality checking circuit 173, a zero checking circuit 174, RS flip-flops 175, 177 and 178, a T-type flip-flop 176, AND gates 179, 180, 183, 184, 185, 188 and 189, and OR gates 181, 182, 186 and 187. The counter 171 is provided for counting the position of the second hand 2. The normal time counter 172 is provided for counting second time of the normal time. The equality checking circuit 173 produces a signal when the content of the second-hand position counter 171 is equal to that of the normal time counter 172. The zero checking circuit 174 produces an output signal in response to a reset signal of the position counter 171 which is generated when it counts 60. The OR gate 186, AND gates 188 and 189 constitute a selector for selecting the output signal of the equality checking circuit 173 or the output signal of the zero checking circuit 174 in response to the level of the output signal 193 of the changeover switch S3. The output signal of the selector is applied to the RS flip-flop (hereinafter called FF) 178 as a set signal. The RS FF 175 is applied with the signal 190 of the R/S switch S1 and the output signal thereof is applied to the AND gate 179. The T-type FF 176 is applied with the signal 191 of the S/S switch S2 and the output signal thereof is applied to the AND gate 180. AND gates 179 and 180 are controlled by the signal 193 of the changeover switch S3 and output signals thereof are applied to the OR gate 182 and the AND gate 185, respectively. The RS FF 177 is applied with the signal 192 of the changeover switch S3 and the output signal thereof is applied to the OR gate 182 and the AND gate 184. The AND gate 183 is adapted to operate as an inhibit-gate for a 64 Hz signal from the frequency divider 13 according to output signals of the RS FF 178 and OR gate 182. The AND gate 184 is adapted to operate as an inhibit-gate for blocking a 1 Hz signal from the divider 13 according to the output signal of the RS FF 177. The AND gate 185 controls the 1 Hz signal of the divider 13 by the output signal of the AND gate 180.

In the normal time display state, the changeover switch S3 is opened (OFF). Accordingly, the signal 193 is at L-level and an H-level signal is applied to one of inputs of the AND gate 188. On the other hand, the output of second-hand position counter 171 is equal to that of the time counter 172, so that an H-level output signal of the equality checking circuit 173 is applied to the other input of the AND gate 188. By the output signal of the OR gate 186, the RF FF 178 is set, and by an output signal of the AND gate 188, the RS FF 177 is reset, so that the FF 178 produces an H-level signal and the FF 177 produces an L-level signal. Therefore, the 64 Hz signal of the divider 13 is inhibited by the AND gate 183 and the 1 Hz signal is applied to the AND gate 184, the output signal of which is applied to the motor driver 14 through OR gate 187. Thus, the second-hand motor 21 is driven at 1 Hz to rotate the second hand 2. The second-hand position counter 171 is synchronized with the rotation of the second hand 2 for counting up.

In order to change the system to the chronograph operation mode, the changeover button 8 is pushed to turn on the changeover switch S3. The RS FF 177 is set by the signal 192 to produce an H-level signal. Accordingly, the 1 Hz signal of the divider 13 is inhibited by the AND gate 184 and the output of OR gate 187 changes to an L-level signal. Thus, the driving of second hand 2 at 1 Hz stops and the 1 Hz signal to the second-hand position counter 171 is stopped.

Further, the signal 192 of the switch S3 is sent to the reset terminal of the RS FF 178 through the OR gate 181 so that the RS FF 178 produces an L-level signal. Thus, one of the inputs of the AND gate 183 is applied with an H-level signal and the other input is applied with an H-level signal of the RS FF 177 through the gate 182. Thus, the AND gate 183 produces the 64 Hz pulses. The output signal of the AND gate 183 is applied to the motor driver 14 through the OR gate 187 so that the second-hand motor 21 is driven by the pulses of 64 Hz to rotate the second hand 2 and the second-hand position counter 171 counts up the pulses synchronizing with the rotation of second hand 2.

When the second hand 2 reaches the zero second position and the counter 171 counts up to zero second, the reset signal is produced from the counter. Therefore, the zero checking circuit 174 produces a signal for opening the AND gate 189 which is in waiting state by the H-level signal 193 of the switch S3. The AND gate 189 produces a signal for setting the RS FF 178 through the OR gate 186 and the FF 178 produces an H-level signal for closing the AND gate 183 to inhibit the 64 Hz signal. Thus, the system is changed to chronograph operation mode and the second hand 2 is located at the zero second position.

When the start/stop button 6 is pushed to turn on the S/S switch S2, the signal 191 is sent to the T-type FF 176 to produce an H-level signal which is applied to the AND gate 180 which is in waiting state by the signal 193 of the switch S3. The AND gate 180 produces a signal for opening the AND gate 185. Thus, 1 Hz signal of the gate 185 is applied to the second-hand motor 21 to drive it at 1 Hz for rotating the second hand 2 through the second-hand gear train 24 and indicating second time of the chronograph. The second-hand position counter 171 counts up the 1 Hz pulses in synchronism with the second hand 2. On the other hand, as will be hereinafter described, the CG hour and minute hands 3 and 4 are released and start rotating so that the chronograph operation starts.

In the chronograph operating state, when the start/stop button 6 is pushed again to turn on the S/S switch S2, the T-type FF 176 produces an L-level signal by the signal 191 and the 1 Hz signal is inhibited by the AND gate 185. Thus, the second hand 2 and second-hand position counter 171 stop to operate, and CG hour and minute hands 3, 4 stop rotating. Accordingly, elapsed time can be measured. If start/stop button 6 is depressed again, chronograph restarts. Thus, the start and stop of the chronograph is repeated at every pushing of the start/stop button 6.

When the set/reset button 7 is pushed to turn on the R/S switch S1, to generate signal 190, irrespective of chronograph start or stop, the RS FF 175 produces an H-level signal which is applied to the OR gate 182 through the AND gate 179. The OR gate 182 produces an H-level signal which is applied to the AND gate 183. The signal 190 is further applied to the OR gate 181, an output signal of which is applied to reset terminals of FFs 176 and 178. Therefore, the T-type FF 176 produces an L-level signal for closing the AND gate 180 which produces an L-level signal, so that the 1 Hz signal of the AND gate 185 is stopped. At the same time, the RS FF 178 produces an L-level signal to open the AND gate 183, the 64 Hz signal of which is applied to the second-hand position counter 171 through the OR gate 187.

When the counter 171 counts 60, the zero checking circuit 174 responds to the reset signal of the counter to produce an output signal. By this signal, the AND gate 189 produces an H-level signal to set the RS FF 178, the output signal of which becomes an H-level, so that the 64 Hz signal is stopped by the AND gate 183. Thus, the OR gate 187 produces an L-level signal to stop the second hand 2 at the zero second position. On the other hand, as hereinafter described, CG hour and minute hands 3, 4 are also reset to the zero positions.

In the reset state, when the start/stop button 6 is pushed to turn on the S/S switch S2, the T-type FF 176 produces an H-level signal dependent on the signal 191 and the AND gate 180 produces a signal to open the AND gate 185. Thus, the 1 Hz signal is applied to the second-hand motor 21 to drive it at 1 Hz, rotating the second hand 2 to restart the chronograph operation.

When the changeover button 8 is pushed to turn off the changeover switch S3, irrespective of the start, stop or reset state, the one pulse signal 192 is applied to the reset terminal of the RS FF 178 through the OR gate 181, so that the FF 178 produces an L-level signal. Thus, an H-level signal is applied to the AND gate 183 to produce the 64 Hz signal so that the second hand 2 and second-hand position counter 171 are driven at 64 Hz. On the other hand, the other signal 193 becomes an L-level. Thus, regardless of the start or stop of the chronograph, that is regardless of the output signal of the FF 176, the AND gate 180 produces an L-level signal so that the 1 Hz signal for the CG second is stopped by the AND gate 185. On the other hand, CG hour and minute hands 3, 4 are reset to the zero positions, as will be hereinafter described.

When the count of the second-hand position counter 171 coincides with the count of the time counter 172, the equality checking circuit 173 produces an output signal which opens the AND gate 188. The RS FF 178 is set by the output signal of the AND gate 188 and produces an H-level signal. The AND gate 183 is applied with an L-level signal to stop the 64 Hz signal. At the same time, the output signal of AND gate 188 resets the FF 177, causing the output thereof to go to a low level. Thus, AND gate 184 produces the 1 Hz signal for the normal time, so that the second hand 2 is rotated to indicate the normal time. The count of the second-hand position counter 171 coincides with the count of the time counter 172 and the counter 171 continues counting up in synchronism with the counter 172.

From the foregoing, it will be seen that the second hand 2 displays both of the normal time and the chronograph time by the operation of switches connected to buttons 6, 7 and 8 of the external manipulating means 11 and the resetting of the hand 2 is performed at the high speed of 64 Hz.

Figure 6:
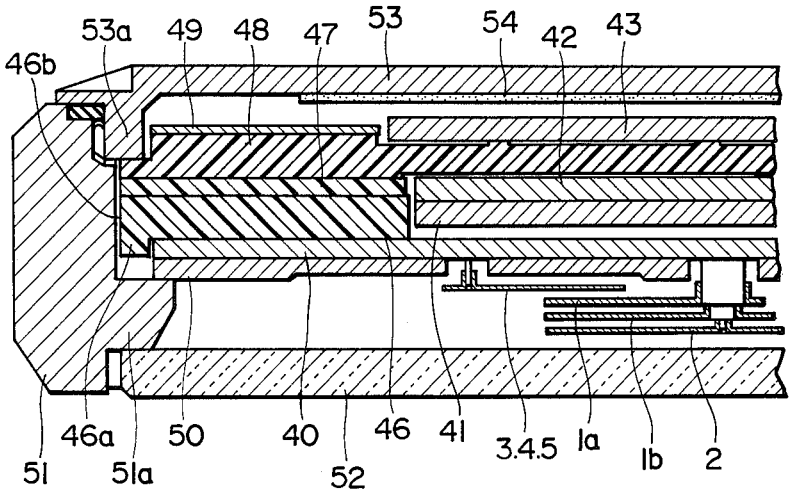
FIGS. 6 and 7 are sectional views showing main portions of the watch.
Figure 8:
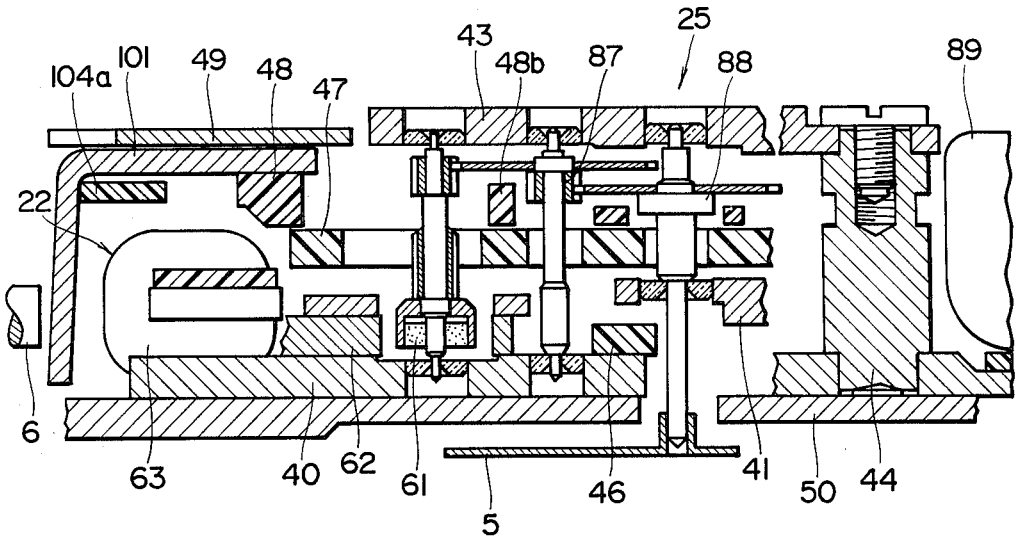
FIG. 8 is a sectional view showing a gear train for a 2/100 second.
Figure 7:
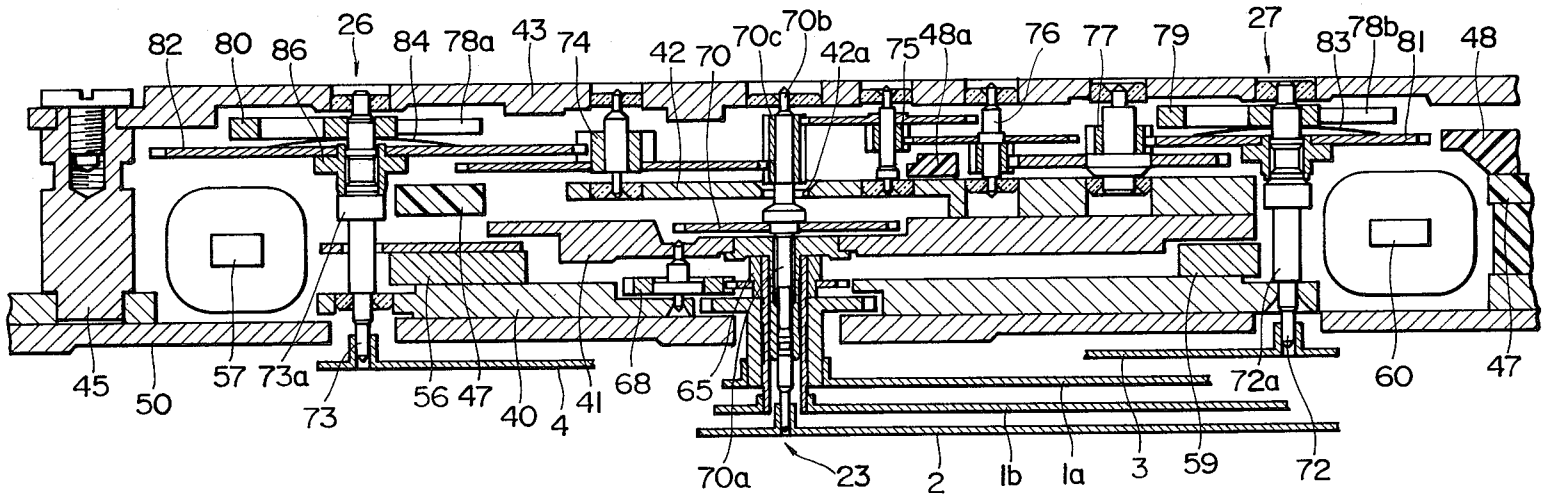

Referring to FIGS. 6 to 8, casing structure of the movement comprises a case body 51, a glass 52 mounted on the case body 51 at a projection 51a thereof, a back 53 having piezoelectric elements 54 welded thereon, and a dial 50. In the present invention, an intermediate frame conventionally used is omitted. Structure for supporting the watch movement comprises a plate 40, intermediate bridge 41, gear train bridge 42, CG bridge 43, and supporting pillars 44 and 45 provided between the bridge 43 and dial 50. The plate 40 as a base of a watch movement is provided for disposing watch elements and supporting lower portions of gear shafts of gear trains. Each of bridges 41, 42 and 43 is made of thin plate and is adapted to support upper portions of corresponding gear shafts A spacer 46 made of plastics is provided for mounting the external actuating members. A circuit board 47 mounting crystal oscillator, electric elements, IC ships (not shown), and having patterns for electrically connecting elements each other is disposed between spacer 46 and plastic cover 48. The spacer 46 mounted on plate 40 is formed to have a larger diameter than the plate 40 to form a plurality of projections 46*b* each of which engages with the inner wall of the case body 51. Further, each projection 46*b* is downwardly projected to form a projecting ring portion 46*a* which is adjacent to the periphery of the plate 40. The projection 46*b* is disposed opposite to the external actuating means so as to prevent a lateral moving of the movement in the casing against the force applied to the external actuating means. In order to prevent axial displacement of the movement, the back 53 is provided with a projecting ring portion 53*a* at the inner periphery thereof to be engaged with the periphery of the circuit cover 49. The projection 51*a* of the case body 51 is engaged with the dial 50. Thus, the movement is received between the ring portion 53*a* and projection 51*a* through plate 40, spacer 46, circuit board 47 and plastic cover 48. The circuit board 47 having the same shape as the movement is firmly fixed between the spacer 46 and plastic cover 48.

Figure 5A:
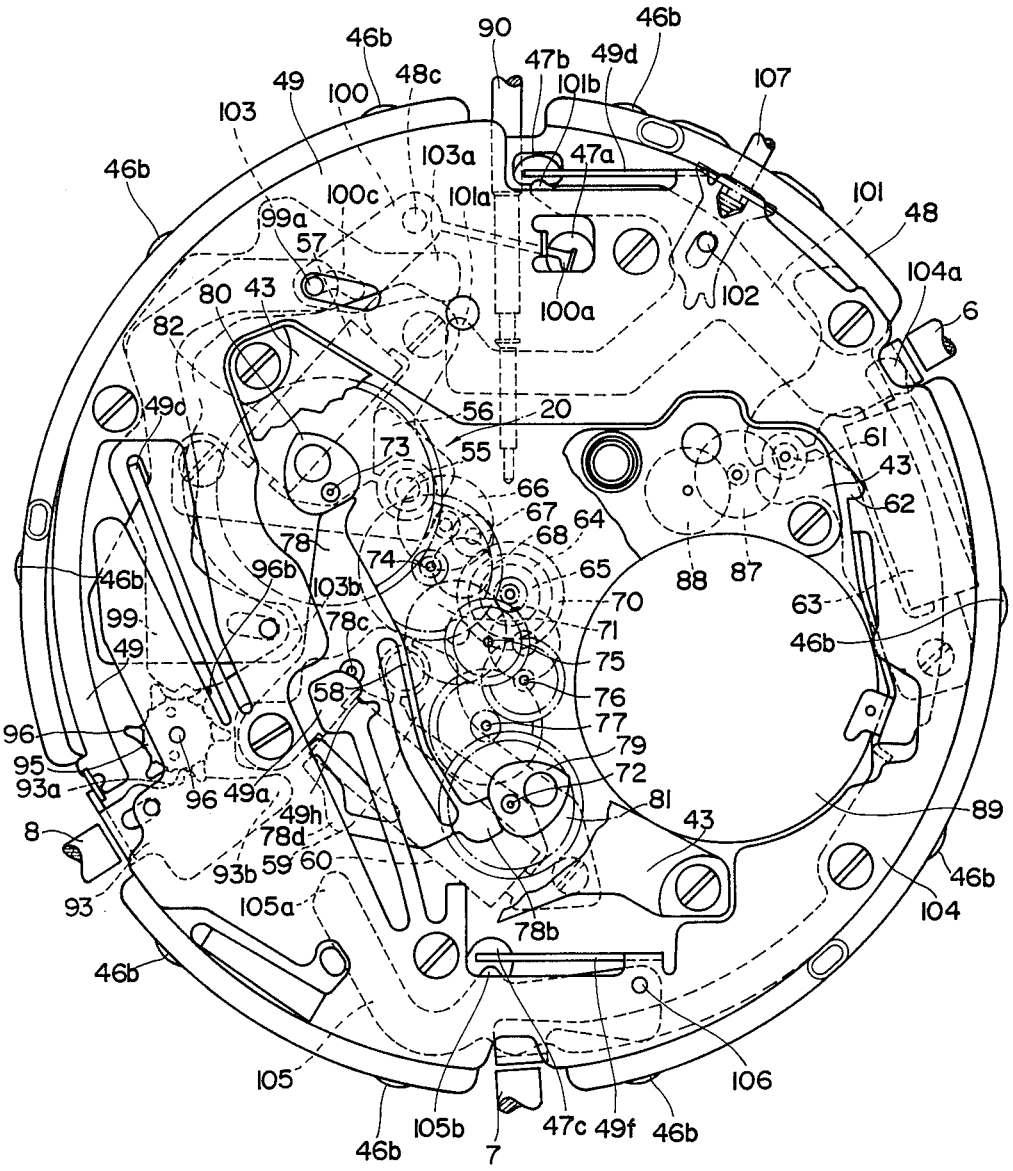
FIG. 5*a* is a schematic plan view of a watch movement.
Figure 9:
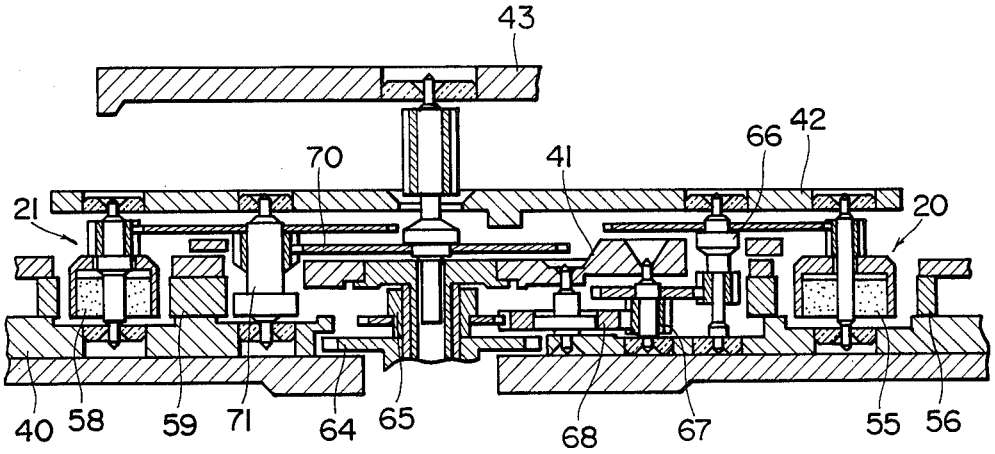
FIG. 9 is a sectional view showing a gear train for a normal time display.
Figure 11:
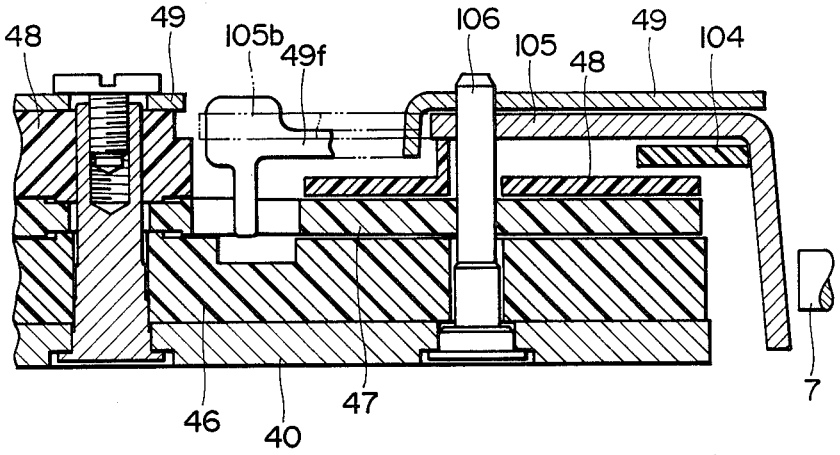
FIG. 11 is a sectional view of a switching mechanism.

Referring to FIGS. 5 to 7, the second-hand motor 21 comprises a coil 60, stator 59, and rotor 58. The rotation of rotor 58 is transmitted through an intermediate wheel 71 to a second wheel 70 carrying the second hand 2. The intermediate wheel 71 forms the second-hand gear train 24 (FIG. 3). As shown in FIG. 9, rotor 58 and intermediate wheel 71 are rotatably supported between a plate 40 and bridge 42.

The hour-minute-hand motor 20 (FIG. 9) comprises a coil 57, stator 56 and rotor 55. A pinion of the rotor 55 engages with a fifth wheel 66 supported between the plate 40 and the bridge 42. The fifth wheel 66 engages with a fourth wheel 67 which in turn meshes with a third wheel 68. The third wheel 68 is engaged with a center wheel 65 carrying the minute hand 1*b*. The rotation of center wheel 65 is transmitted through a minute wheel (not shown) to an hour wheel 64 carrying the hour hand 1*a*. Thus, these wheels form the hour-minute hands gear train 23.

Referring to FIG. 8, the CG 2/100-second-hand motor 22 comprises a coil 63, stator 62, and rotor 61. The rotation of the rotor 61 is transmitted to a CG 2/100-second wheel 88 through an intermediate wheel 87 forming the gear train 25. Thus, the CG 2/100-second hand 5 secured to the wheel 88 indicates 2/100 second at chronograph operation.

Figure 5B:
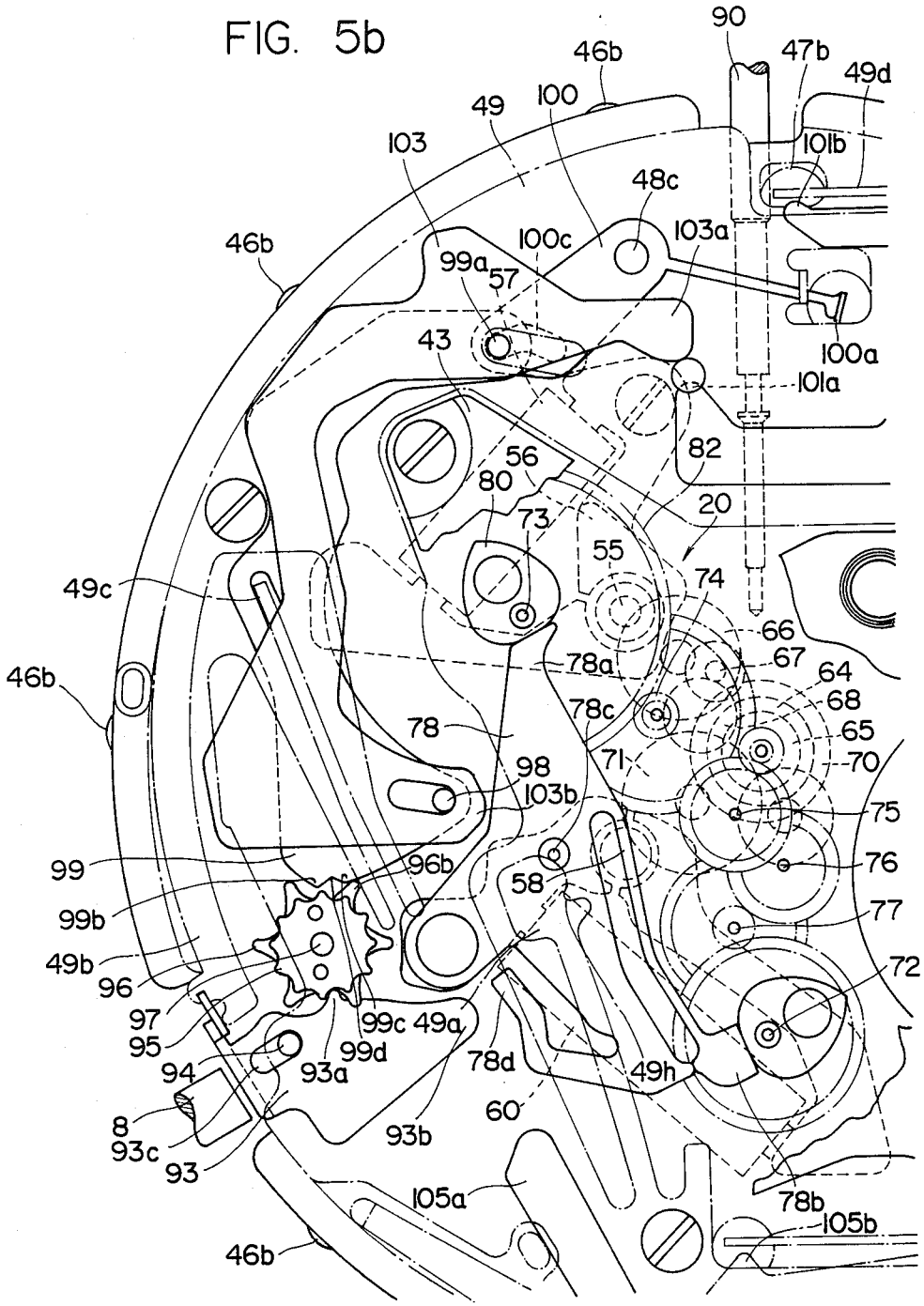
FIG. 5*b* is an enlarged plan view showing a main part of a part of FIG. 5*a;*

As shown in FIG. 7, a shaft 70*a* of second wheel 70 passes a hole 42*a* of bridge 42 and is supported by bridge 43 at an end 70*b*. A inion 70*c* is formed at an upper portion of second wheel 70 and engages with an intermediate wheel 74 forming the CG minute-gear train 26 and with a third intermediate wheel 75. The intermediate wheel 74 meshes with a CG minute gear 82 for rotating a CG minute wheel 73. The third intermediate wheel 75 is disposed to overlap with the intermediate wheel 74 in plan view, but not to overlap with it in elevational view. The third intermediate gear engages with a second intermediate wheel 76 which engages a first intermediate wheel 77, forming the CG hour-gear train 27. The first intermediate wheel 77 engages with a CG hour gear 81 for driving a CG hour wheel shaft 72*a* of a CG hour wheel 72. Thus, as shown in FIG. 5*b*, CG minute-gear and hour-gear trains 26, 27 are separately provided from second wheel 70.

Resetting mechanisms 28 and 29 are provided between the CG minute gear 82 and CG minute wheel shaft 73*a*, and between the CG hour gear 81 and the CG hour wheel shaft 72*a*, respectively.

Explaining the construction of the resetting mechanism with reference to FIG. 7, a hub 86 of the CG minute gear 82 is rotatably mounted on the CG minute wheel shaft 73*a* and a heart cam 80 is secured to the shaft 73*a*. An initially corned disc spring 84 as a slipping mechanism is provided between the heart cam 80 and the gear 82 so as to transmit the torque of the gear 82 to the shaft 73*a*. An actuating end 78*a* of a fly-back lever (or hammer) 78 is adapted to be engaged with the heart cam 80 by operating external actuating members. The fly-back lever 78 is rotatably supported by a pin 78*c* (FIG. 5). When the actuating end 78*a* of the fly-back lever 78 engages with the heart cam 80, the heart cam is rotated to the zero minute position, so that the shaft 73*a* is forcibly rotated to the zero position, with slipping of the slipping mechanism by the spring 84. Namely, the friction force of the slipping mechanism is so selected that the spring 84 slips without rotating the CG minute gear 82 in speed increasing direction. In other words, the CG minute gear 82 continues to rotate, even if the shaft 73*a* stops. The number of rotation of the rotor 58 of the second-hand motor 21 is reduced to rotate the gear 82, and, on the other hand, the torque of the rotor is increased. If the torque at the gear 82 is 3 g.cm, the slip torque (friction force) at the spring 84 is set to about 0.4–0.8 g.cm in order to prevent the reverse rotation of the gear 82. If the slip torque is smaller than 0.4 g.cm, CG minute hand 4 is unnecessarily rotated by a shock such as a shock by the fall of the watch, which causes mis-measurement or chronograph time. Such a displacement of the minute hand is caused by the unbalance of the hand and heart cam 80 in weight.

The resetting mechanism 29 for CG hour is the same as the resetting mechanism 28, comprising CG hour wheel shaft 72*a*, heart cam 79, disc spring 83, and actuating end 78*b* of fly-back lever 78. In the gear train for the CG hour, the torque at the CG hour gear 81 is about 36 g.cm, which is sufficient for preventing the reverse rotation of the gear by the slip torque 0.4–0.8 g.cm of the slipping mechanism of spring 83.

As shown in FIGS. 7 and 8, circuit cover 48 is provided with guide portions 48*a* and 48*b* for preventing wheels, which are liable to fall at assembling working of the watch, from falling at the assembling.

Arrangements of CG minute wheel 73, CG hour wheel 72, and CG 2/100-second wheel 88 are illustrated in FIG. 5. Since the CG 2/100-second gear train 25 and CG 2/100-second hand motor 22 for driving the CG 2/100-second wheel 88 are disposed independently of other gear trains, a motor having a large size can be disposed in a peripheral portion of the movement. Further, the CG 2/100-second wheel 88 and the gear train 25 are disposed in a fan-shaped space between a battery 89 and a stem 90 with a predetermined distance from the center of the watch. Since, in the space, other members are not disposed, the gear train does not overlap other members. Thus, the thickness of the watch is not increased by the CG 2/100-second chronograph system.

Figure 10:
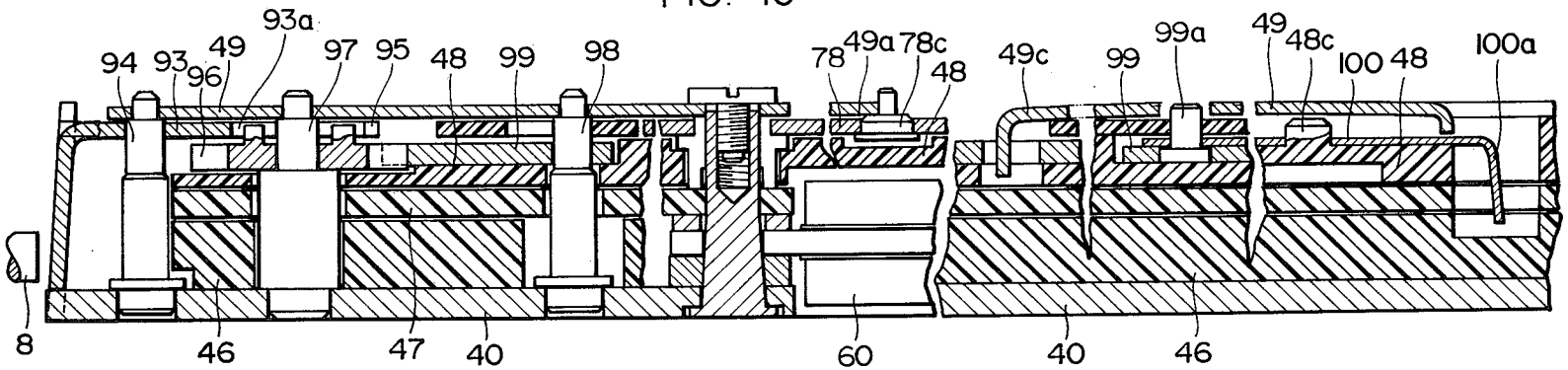
FIG. 10 is a sectional view showing a partof a chronograph lever mechanism.

Lever mechanisms for switches S1, S2, S3 and resetting mechanisms 28 and 29 will be described hereinafter with reference to FIGS. 5 and 10. In the normal time indication mode, actuating ends 78*a* and 78*b* engage with heart cams 79, 80 to keep CG minute hand 3 and hour hand 4 in zero positions, and second hand 2 rotates at 1 Hz. A pin 78*c* of the fly-back lever is engaged with an end portion of a spring arm 49*a* formed in bridge 49, so that the fly-back lever 78 is held in the position to keep zero positions of hands 3 and 4. In such a state, switches S1 to S3 are opened.

An actuating lever 93 is radially slidably provided by the engagement of a slot 93*c* formed in the lever with a pin 94 mounted on plate 40. An end portion of a spring arm 49*b* engages with an end of the actuating lever 93 to urge it in the outward direction of the watch. A double rachet wheel comprising an upper wheel 95 and a lower wheel 96 which are integrated with each other is rotatably mounted on the shaft 97 secured to the plate 40. A pawl 93*a* formed in the actuating lever 93 engages with the upper wheel so as to rorate the double ratchet wheel by the movement of the actuating lever 93 toward the center of the watch. The upper wheel 95 has 12 teeth and lower wheel 96 has 6 teeth, so that the lower wheel 96 rotates ½ pitch per one stroke of the actuating lever 93.

An actuating cam lever 99 rotatably mounted on a pin 98 secured to plate 40 engages with the lower wheel 96. The actuating cam lever 99 has a cam portion comprising two teeth 99*b*, 99*c* and recess 99*d* between the teeth. The teeth 99*b* and 99*c* are shaped to be engaged two teeth of lower wheel 96, and recess 99*d* is adapted to be engaged with the tip end of the tooth of lower wheel 96.

Mounted on an end of lever 99 is a pin 99*a* which is alternately located at a first position and second position in dependence on the engagement state of the cam portion with the lower wheel 96. The pin 99*a* engages with a slit cam 100*c* of a switch lever 100 pivotally mounted on a pin 48*c*. The switch lever 100 has a movable contact 100*a* which is to be engaged with a fixed contact on circuit board 47, forming switch S3.

When the button 8 is depressed to push the actuating lever 93, the lower wheel 96 is rotated ½ pitch in the counterclockwise direction, so that the tip of tooth 96*b* engages with the recess 99*d* of the cam lever 99. Thus, the lever 99 is clockwisely rotated to cause the switch lever 100 to rotate in the counterclockwise direction to engage the movable contact 100*a* with fixed contact to close the switch S3. Thus, second hand 2 is rotated to the zero position by pulses of 64 Hz to provide the chronograph mode.

Explaining a start/stop mechanism for the chronograph, a start/stop lever 101 is pivotally mounted on a shaft 102 secured to the plate 40 and urged in the counterclockwise direction by an end 104a of a spring plate 104. An end 101*a* of the start/stop lever 101 is positioned near an end 103*a* of a start/stop intermediate lever 103 which is pivotally mounted on the pin 99*a* secured to the actuating lever 99. Another end 101*b* of lever 101 engages with a movable contact 49*d* formed in bridge 49, which forms the switch S2 together with a fixed contact. Another end 103*b* of the lever 103 is located near the hammer 78.

When the start/stop button 6 is depressed, the start/-stop lever 101 is clockwisely rotated to push the end 103*a* of the lever 103, so that the lever 103 rotates in the counterclockwise direction. The end 103*b* of the lever 103 engages with the hammer 78 to rotate it clockwisely to remove ends 78*a* and 78*b* from heart cams 79 and 80 to release shafts 72*a* and 73*a*. On the other hand, the end 101*b* of the lever 101 pushes the movable contact 49*d* to engage it with the fixed contact to close the switch S2 to rotate the second-hand motor 21 at the rate of one step per second by 1 Hz pulses. In such a state, the pin 78*c* of the hammer 78 engages with a notch 49*h* of the spring arm 49*a*. Accordingly, CG minute hand 4 and hour hand 3 also atart to rotate in synchronism with the second wheel 70.

When the start/stop button 6 is pushed again, switch S2 is closed again to stop the motor 21 as described above. On the other hand, although the intermediate lever 103 is rotated, the hammer 78 is not rotated, because the hammer is held by the engagement of pin 78*c* with notch 49*h*.

The CG 2/100-second-hand motor 22 independently starts and stops by the operation of the push button 6 to indicate 2/100 second. Thus, elapsed time can be measured.

A reset lever 105 is pivotally mounted on a shaft 106 and biased to the set/reset button 7 by an end of spring plate 104. The reset lever 105 has an end 105*a* adapted to be engaged with an end 78*d* of hammer 78 and another end 105*b* adapted to be engaged with a movable contact 49*f* which forms the switch S1 together with a fixed contact.

When the set/reset button 7 is pushed, irrespective of modes of chronograph operation, the reset lever is clockwisely rotated, so that the end 105*a* engages with end 78*d* to rotate the hammer 78 in the counterclockwise direction. Accordingly, actuating ends 78*a* and 78*b* engage with heart cams 79 and 80 to rotate shafts 72*a* and 73*a* to the zero positions. At the same time, the other end 105*b* pushes the movable contact 49*f* to fixed contact to close the switch S1. Thus, the second hand 2 rotates to the zero position. If the start/stop button 6 is pushed, chronograph operation restarts.

When changeover button 8 is pushed, irrespective of chronograph operation modes such as chronograph start, stop and reset, end 93*b* of actuating lever 93 engages with end 78*d* of hammer 78, causing it to rotate counterclockwisely. Accordingly, actuating ends 78*a* and 78*b* engage with heart cams 79 and 80 to return hands 3 and 4 to zero positions. On the other hand, upper and lower wheels 95 and 96 are rotated by pawl 93*a*, so that teeth 99*b* and 99*c* engage between teeth of the lower wheel 96. Thus, the cam lever 99 rotates in the counterclockwise direction to the position of FIG. 5*a* to open the switch S3. Accordingly, second hand 2 returns to the normal time at the rate of 64 Hz.

Under such a normal time indicating condition, if the set/reset button 7 is pushed to close the switch S1, CG 2/100-second hand 5 is rotated to a desired position, so that the timer is set. Thereafter, when the start/stop button 6 is pushed to close switch S2, the timer operates during the set time. In such an operation, although levers 105 and 101 are rotated by buttons 7 and 6, ends 105*a* and 101*a* do not engage with hammer 78 and lever 103. Accordingly, the normal time indicating condition does not change.

As seen from FIG. 5, the CG lever mechanisms for operating fly-back lever 78 are disposed between the outer periphery of the movement and the CG bridge 43 in plain. Therefore, the CG lever mechanism is easily mounted on the circuit cover 48 after gear trains 25, 26, 27 are assembled.

From the foregoing, it will be understood that the CG hour hand 3 and CG minute hand 4 are independently driven through respective gear trains 27, 26 from the second wheel 70, so that the gear trains can be easily disposed to meet the requirement for disposition of chronograph hands.

While the invention has been described in conjunction with preferred specific embodiment thereof, it will be understood that this description is intended to illustrate and not limit the scope of the invention, which is defined by the following claims.

What is claimed is:

1. An electronic timepiece with a chronograph system having a minute hand, and hour hand, a first chronograph second hand, a chronograph minute hand and a chronograph hour hand, comprising:

a first motor for driving the first chronograph second hand;

a first gear train for transmitting the output of the first motor to a second wheel of the first chronograph second hand;

a second gear train for transmitting the rotation of the chronograph second wheel to a minute wheel of the chronograph minute hand;

a third gear train separately provided from the second gear train and provided for transmitting the rotation of the chronograph second wheel to an hour wheel of the chronograph hour hand.

2. The electronic timepiece according to claim 1 further comprising a second motor for driving the minute hand and the hour hand, and slipping means provided in the second gear train and the third gear train for causing the slipping of a part of each of the gear trains to cause the first chronograph second hand to indicate the normal time.

3. The electronic timepiece according to claim 1 further comprising a second chronograph second hand for indicating the chronograph second at a smaller unit than the first chronograph second hand, a third motor for driving the second chronograph second hand, and a gear train for transmitting the torque of the third motor to a wheel of the second chronograph second hand.

4. The electronic timepiece according to claim 3 wherein the third motor, the gear train and the wheel of the second chronograph second hand are disposed in a space between a battery and a stem provided in the timepiece.

5. The electronic timepiece according to claim 1 wherein the minute hand, hour hand and the first chronograph second hand are co-axially disposed at a central portion of the timepiece.

6. The electronic timepiece according to claim 5 wherein one of the chronograph minute hand and the chronograph hour hand is disposed on an extension of a line connecting a stem of the timepiece and the axis of the first chronograph second hand.

* * * * *